US005281315A

United States Patent [19]

Krapivina et al.

[11] Patent Number: 5,281,315

[45] Date of Patent: Jan. 25, 1994

[54] GAS PLASMA TREATMENT OF PLANT SEEDS

[75] Inventors: Svetlana A. Krapivina; Alexander K. Filippov; Tatiana N. Levitskaya; Andrei Bakhvalov, all of St. Petersburg, U.S.S.R.

[73] Assignee: Plasma Plus, Los Angeles, Calif.

[21] Appl. No.: 959,420

[22] Filed: Oct. 13, 1992

[51] Int. Cl.[5] ..... H05F 3/00

[52] U.S. Cl. ..... 204/164; 204/165

[58] Field of Search ..... 204/164, 165

[56] References Cited

PUBLICATIONS

Zahrov V. A., Kresny Y. P. Shchurev A. N., "Effect of Glow Discharge Treatment of Wheat Seeds on their Water Absorption and Plantation Qualities", Electronic Treatment of Materials 1989, #1, pp. 54–56.

*Primary Examiner*—John Niebling
*Assistant Examiner*—C. Delacroix-Muirheid
*Attorney, Agent, or Firm*—Natan Epstein

[57] ABSTRACT

Crop yields are improved by treatment of the plant seeds in a low temperature plasma discharge generated between spaced apart electrodes connected to a source of high frequency electrical power.

10 Claims, 1 Drawing Sheet

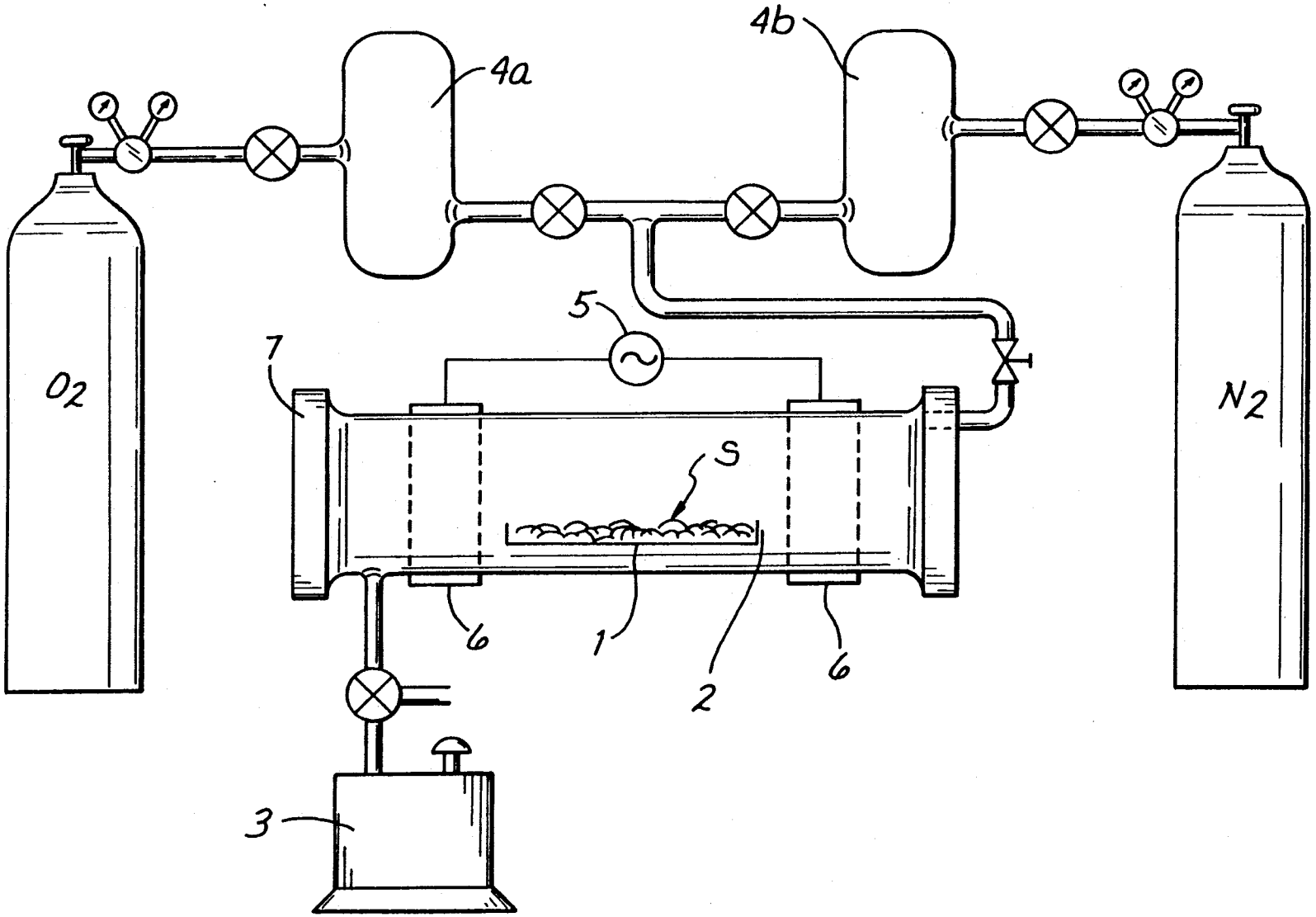
N2
O2
4a
4b
5
6
6
7
S
1
2
3

GAS PLASMA TREATMENT OF PLANT SEEDS

BACKGROUND OF THE INVENTION

1. Field of the Invention

This invention relates to the field of agriculture, and in particular relates to the treatment of crop seeds, prior to planting, in a low temperature plasma in order to improve the yield of grain, bean and vegetable crops.

2. State of the Prior Art

Known treatments of plant seeds prior to planting include exposure to electric and magnetic fields, electric corona discharge and ultra-violet radiation, to increase germinating power, sprouting rate and yield of the crop.

The effect of static magnetic fields on various crop plants is described in Dayal Sarveshwar, Singh R.P., Effect of the Seed Exposure of Magnetic Field on the Height of Tomato Plants (Indian J. Agr. Sci., 1986, v. 56, #6, pp. 483–486). Seregina M. T. Pavlova N.A., Alymova Z.I., Biological Effect of Magnetic Field on Growth, Development and Productivity of Plants of Winter-crop Grain Cultures (Electronic Treatment of Materials, 1991, #1, pp. 67–71) describes stimulation of metabolic processes and changes in cell membrane permeability, which in turn lead to intensified growth processes and enhanced plant productivity.

Pretreatment of seeds in an electric corona discharge, described in Seregina M.T., Effectiveness of Utilization of Physical Factors during Pre-Plantation Treatment of Potato Tubers/Electronic Treatment of Materials, 1988, #1, pp. 67–74, subjects the seeds to an array of stimuli, including wide-band electromagnetic radiation, ionization, ozone and nitrogen oxides. This particular treatment, however, offers a relatively small zone where a uniform activation effect of the subject seeds is obtainable.

USSR patent No. 211931, class A 01G, 07/04/67, describes exposure of seeds to an ionizing electric field by placing seeds in an inter-electrode space. With a field intensity of 4.5 KW/cm, the yield of rice crops is increased by 8.5%. This method is considered to be insufficiently effective.

According to USSR patent No. 880286 (class A 01C 1/100, A01C 7/04, 11/15/81), seeds are exposed to an electric static field with an intensity of 3–4.5 KW/cm for 5 seconds, 10 days before planting. Then, 5 days before planting, the seeds are again exposed to an alternating current electric field having an intensity of 3–4.5 KW/cm for 5 seconds, resulting in an 18% increase in rice crop productivity.

In USSR patent No. 880287 (class A 01C 1/10, 11/15/81), seeds are treated in a corona discharge field with a field intensity of 4 KW/cm for 3 seconds. The seeds are then treated with 30–40% chlorine choline chloride solution (10–15 liters of solution per 1 ton of seeds). A crop yield increase of 14.6% is obtained, and spoilage resistance is 5 points, compared to 2 points for untreated control samples.

In USSR patent No. 191928 (class A 01C 1/00, 11/26/64), seeds are exposed to electromagnetic oscillations in a solution of microelements, yielding an average 10% increase yield. This improvement is considered low.

In USSR patent No. 660612 (class A 01 1/100, 12/27/77) seeds are heat treated, treated in an electric corona field discharge and soaked in a solution of micro- and macro-elements consecutively. This treatment yields a 26.6% increase in crop yield, but the treatment is complex and multi-staged, and requires use of sophisticated equipment.

Prior methods which attempt activation of plant seeds by exposure to electric corona discharge share a common drawback, namely the non-uniformity of the activation effect obtained on the treated seeds. What is needed therefore is a method for treatment of crop plant seeds which results in large gains in crop yield and uniform results among substantial quantities of treated seed volumes. These shortcomings can be overcome by treatment of crop plant seeds in a low pressure gas electric glow discharge.

A known method of treating wheat seeds in a glow discharge is described by Zahrov V. A., Kresny Y.P. Shchurev A.N., "Effect of Glow Discharge Treatment of Wheat Seeds on Their Water Absorption and Plantation Qualities", Electronic Treatment of Materials 1989, #1, pp. 54–56. According to this reference, seeds are placed on a grid cathode, and the body of the treatment chamber serves as the anode. A glow discharge is generated in residual atmospheric air at between 3–4 Torr pressure and 350–400 V voltage. At a current density of 3 mA/cm2 the treatment time is 30 seconds. Under these conditions, the temperature of the seeds does not rise above 55 degrees Centigrade. The moisture capacity of wheat grains following this treatment is 12%, compared to 10.5% for untreated control grains. Drawbacks of this prior art method include difficulty in maintaining stable conditions so that the temperature of the seeds does not reach 60 degrees centigrade, low efficacy of the process because seed activation occurs only when ions bombard the cathode, and the impossibility of using this apparatus for continuous treatment processes.

SUMMARY OF THE INVENTION

These shortcomings of the prior art can be overcome by treating crop plant seeds in a high frequency glow discharge with optimized discharge parameters as disclosed below.

The present invention provides an improved method for the treatment of plant seeds prior to planting, according to which method the seeds are exposed to a low temperature gas plasma discharge in an inorganic gas or mixture of inorganic gasses. Oxygen, atmospheric air, or mixtures of Oxygen and nitrogen (with a nitrogen concentration below 80%) may be used. The discharge is generated at a gas pressure in the range of 0.1 to 5 Torr. The treatment time may range from 5 seconds to 300 seconds. The plasma discharge is generated using a high frequency electric power generator, delivering power at a frequency in the range of 1 Mhz to 40 Mhz, with a specific power of the glow discharge ranging from 0.003 to 1.5 W/cm3.

BRIEF DESCRIPTION OF THE DRAWING

FIG. 1 is a schematic illustration of a low temperature gas plasma chamber arrangement used for treatment of plant seeds according to the improved process of this invention.

DETAILED DESCRIPTION OF THE PREFERRED EMBODIMENTS

Low pressure gas plasmas are used in various treatment processes of materials other than plant seeds. Plastic materials are treated in this manner, for example, to increase the surface wetting properties of the materials. A chief characteristic of low temperature gas plasmas is the nonisothermicity, i.e. Te >>Ti=Tg of the plasma, where Te - temperature of electrons Ti - temperature of ions Tg - temperature of gas In the plasma atmosphere, the basic activation effect is caused by free electrons. For instance, the following processes take place in an oxygen plasma:

$$O_2+e \rightarrow O_2(^1\Delta_g)+e$$

$$O_2+e \rightarrow O_2(^3\Sigma_4)+3$$

$$O_2(^3\Sigma_4)+e \rightarrow -O\ (3_p)+O\ (^1D)+e$$

$$O\ (3_p)+O_2+M \rightarrow O_3+M$$

$$\text{Surface}+\{O\ (^3p),\ O_2(^1\Delta g),\ O_3\} \rightarrow \text{surface modification}$$

In a gas plasma where the gas is a mixture of nitrogen and oxygen, the following additional processes take place:

$$O\ (^3P)+N_2 \rightarrow NO+N$$

$$N+O_2 \rightarrow O\ (^3p)+NO$$

$$N_2+e \rightarrow N^*_2(n_v)+e$$

$$N^*_2(n_v)+O_2 \rightarrow O_2(^3\Sigma^-{}_4)+N_2 \rightarrow O\ (^3p)+O\ (^1D)+N_2$$

In other words, chain processes take place which lead to the formation of nitrogen oxide. The last reaction in the above sequence is the result of inelastic metastable-neutral collisions, which further enhance the seed activation obtained according to this invention.

The active components $O_2(^1\Delta g)$, O ($^3$p), $O_3$ have increased chemical activity at the lower temperatures found in a low pressure gas plasma discharge.

Chemical interaction with material surfaces exposed to this plasma leads to the formation of hydrophylic chemical bonds at the surfaces. The exposed surface is activated by this treatment, resulting in modification of the surface properties, in particular its susceptibility to wetting by water.

The apparatus employed for the low pressure plasma treatment is schematically illustrated in FIG. 1, and the plasma treatment process will now be described.

A shallow tray 1 carries the seeds S to be treated. The tray 1 is placed in a plasma treatment chamber 2. Gas bottles 4*a* and 4*b* containing one or more inorganic gases are connected through suitable valves and conduits to the chamber 2. The plasma chamber is evacuated by means of vacuum pump 3. The vacuum system, including the chamber 2, is then flushed with oxygen gas from one of the bottles 4*a*, 4*b*, and the chamber 2 is then again evacuated. Oxygen gas is then fed into the chamber 2 to a pressure from 0.1 to 5 Torr. Two annular electrodes 6 are mounted in axially spaced apart relationship exteriorly on the tubular chamber 2. The output of a high frequency electrical power generator 5 is connected to the electrodes 6 and supplies power to generate a glow discharge in the chamber 2 between the electrodes. The preferred specific power of the discharge is between 0.003 and 1.4 W/cm3, and the discharge may be sustained for a period of 5 to 300 seconds. Then both the vacuum pump 3 and the generator 5 are turned off. The interior of the chamber 2 is brought to atmospheric pressure and the treated seeds are removed from the chamber by opening the end closure 7 of the chamber.

The following are specific examples of seed treatments according to this invention.

EXAMPLE 1

Soy-bean seeds placed on tray 1 were placed in the plasma discharge chamber 2. Air was extracted by vacuum pump 3, and oxygen gas introduced into chamber 2 to a pressure of 1.5 Torr. A glow discharge was ignited between electrodes 6 by supplying high frequency voltage (at 6.25 Mhz) to the electrodes for 20 seconds with a specific power input of 0.35 W/cm3. The glow discharge was then extinguished and vacuum pumping of chamber 2 stopped. Air was admitted into the chamber 2 to atmospheric pressure and the tray 1 was removed from the discharge chamber 2.

The specific water absorption of the treated seeds was found to be 95%, compared to 30% for untreated control seeds. The germination time of the treated seeds was reduced by a factor of four, to 12 hours. The germinating power, i.e the percentage of seeds germinating after planting, of the treated seeds was 100%. The germinating power of untreated control seeds was 68%.

EXAMPLE 2

Soy-bean seeds of the Bukuria variety were placed on tray 1 in the plasma discharge chamber 2 and treated for 20 seconds under the conditions indicated in Example 1, but with the specific power of the electric discharge increased to 0.5 W/cm3. Both treated and control seeds were planted simultaneously for further observation, and the results are given in Table 1 below.

TABLE 1

SOY-BEAN, BUKURIA VARIETY

| Phase of development | Seeds not subjected to plasma chemical treatment prior to planting | Seeds subjected to plasma chemical treatment prior to planting |
|---|---|---|
| 1. Date Planted | May 4, 1991 | May 2, 1991 |
| 2. Full Sprouts | May 22, 1991 | May 13, 1991 |
| 3. Start Blossom | June 27, 1991 | June 16, 1991 |
| 4. Full Blossom | June 30, 1991 | June 17, 1991 |
| 5. Ripening | September 3, 1991 | August 18, 1991 |
| 6. Quantity of Plants in harvest thousand/hec. | 248 | 524 |
| 7. Height of plants in cm | 44.8 | 83.0 |
| 8. Quantity of beans per one plant | 8.7 | 47.0 |
| 9. Length of bean (in cm) | 3.7 | 3.9 |
| 10. Grains per bean | 2.4 | 3.1 |
| 11. Weight of 1,000 seeds in gr. | 135.7 | 155.9 |
| 12. Seed moisture (%) | 11.1 | 11.5 |
| 13. Crop at 14% moisture 100 kg/hec | 7.1 | 31.7 |

The initial stages of seed germination and growth are determined by the rate at which water is supplied to the plant. Therefore, specific absorption of water (the quantity of water absorbed per unit of seed mass) was used as one of the criteria of efficacy of the novel treatment. The shells of plant seeds are normally hydrophobic. Following treatment of the seeds by the process described herein, the seed surface absorbs water intensively. Hydrophilicity of the seed surface positively affects the energy of germination in low moisture soil.

Plasma treatment under conditions of high specific power of the plasma discharge (>1.5 W/cm3) and prolonged treatment time (>500 seconds) may result in heating of the seeds to a temperature above 60° Centigrade. This leads to seed death or destruction, due to coagulation of protein material of the seed endo-sperm. This undesirable phenomenon was not observed to occur at specific powers of the plasma discharge in the range of 0.003 to 1.5 W/cm3 and treatment time ranging from 5 to 500 seconds.

TABLE 2

EFFECT OF TREATMENT TIME ON SPECIFIC WATER ABSORPTION, GERMINATION TIME AND SPROUTING OF SOY-BEAN SEEDS

| Specific Power W/cm3 | Treatment Time, Sec. | Specific Water Absorption, $\Delta m/m_o$, % | Germination Period, hours | Sprouting in % |
|---|---|---|---|---|
| — | — | 30 | 48 | 68 |
| 0.5 | 3 | 45 | 14 | 73 |
| 0.5 | 5 | 75 | 13 | 83 |
| 0.5 | 25 | 90 | 12.5 | 95 |
| 0.5 | 50 | 100 | 12.5 | 100 |
| 0.5 | 100 | 102 | 12 | 100 |
| 0.5 | 200 | 105 | 12 | 100 |
| 0.5 | 300 | 107 | 11.5 | 100 |
| 0.5 | 400 | 109 | 11.5 | 95 |
| 0.5 | 500 | 111 | 11 | 85 |
| 0.5 | 600 | 113 | 11 | 73 |
| Corona discharge | | 45 | 14 | 73 |

TABLE 3

EFFECT OF SPECIFIC POWER OF HIGH FREQUENCY DISCHARGE ON SPECIFIC WATER ABSORPTION, GERMINATION PERIOD AND SPROUTING OF SOY-BEAN SEEDS

| Specific Power W/cm3 | Treatment Time, Seconds | Specific Water Absorption, $\Delta m/m_o$, % | Germination Period, Hours | Sprouting in % |
|---|---|---|---|---|
| — | — | 30 | 48 | 68 |
| 0.002 | 20 | 45 | 14 | 75 |
| 0.003 | 20 | 55 | 12.5 | 80 |
| 0.1 | 20 | 70 | 12 | 98 |
| 0.25 | 20 | 90 | 11 | 100 |
| 0.5 | 20 | 108 | 10 | 100 |
| 1.0 | 20 | 112 | 10 | 100 |
| 1.2 | 20 | 107 | 10 | 100 |
| 1.4 | 20 | 85 | 11.5 | 95 |
| 1.5 | 20 | 55 | 12.5 | 80 |
| 1.6 | 20 | 25 | 51 | 50 |
| Corona discharge | | 45 | 14 | 73 |

TABLE 4

EFFECT OF PLASMA GENERATING GAS COMPOSITION SPECIFIC WATER ABSORPTION, GERMINATION PERIOD AND SPROUTING OF SOY-BEAN SEEDS

| Treatment time, seconds | Specific Power, W/cm3 | [02]/[N2], in % | Specific Water Absorption, $\Delta m/m_o$, % | Germination Period, hours | Sprouting, in % |
|---|---|---|---|---|---|
| — | — | — | 30 | 48 | 68 |
| 20 | 0.5 | 100 | 120 | 10 | 100 |
| 20 | 0.5 | 80 | 115 | 11 | 100 |
| 20 | 0.5 | 60 | 110 | 11.5 | 100 |
| 20 | 0.5 | 40 | 105 | 12 | 95 |
| 20 | 0.5 | 20 | 100 | 12 | 90 |
| 20 | 0.5 | 0 | 60 | 28 | 74 |
| 20 | 0.5 | 20 | 45 | 14 | 73 |
| Corona discharge | | | | | |

Note to tables 2–4: Germination period is measured from planting of the seed until rudimentary root and leaf structure appear while the seeds are maintained in a wet condition suitable for germination.

TABLE 5

COMPARISON OF VARIOUS METHODS OF PRE-SOWING TREATMENT OF SEEDS

| Type of Treatment | Crop Capacity 100 kg/Hec: | Crop Capacity % | Increase in Crop yield 100 kg per hectare |
|---|---|---|---|
| Untreated Control | 31 | 100 | — |
| Electrostatic Field E = 4.5 KW/cm. t = 5s USSR Pat. 211931 | 33.8 | 108.5 | 2.8 |
| Electric Field of Alternating Current E = 4.5 KW/cm t = 5s | 32.6 | 104.8 | 1.6 |
| Electrostatic Field (E = 4.5 KW/cm t = 5s) + Electric Field of Alternating Current E = 4.5 KS/cm t = 5s USSR Pat. 880286 | 36.6 | 118.0 | 5.6 |
| Corona Discharge E = 4 KW/cm t = 5s USSR Pat. 211931 | 32.2 | 104.2 | 1.2 |
| Corona Discharge (E = 4 KW/cm t = 3s) + Chlorine-choline-chloride USSR Pat. 880287 | 35.7 | 114.6 | 4.7 |
| Corona Discharge (E = 4 KW/cm t = 3s) + Macro- and Micro Elements | 34.1 | 109.6 | 3.1 |
| Heat Treatment + Corona Discharge (E = 4 KW/cm t = 3s) + Macro- and Micro Elements | 39.3 | 126.6 | 8.3 |
| High Frequency Glow Discharge (W = 1.0 W/cm3 t = 109s, $O_2$) | 40.6 | 131.0 | 9.6 |

Table 3 shows that treatment of seeds under the conditions and parameters of plasma discharge treatment described above prior to planting leads to a general stimulation of germination activity, enhancement of metabolic processes in the plant cells and improved development of the root system and conducting tissues of the plant stem. The treatment enhances bushing of the plants, growth of lateral sprouts and generates development of axil buds which are not developed in untreated seeds planted under normal conditions. Altogether, the treatment described herein leads to increased biological mass of the resulting plants and greater bean Yield per plant, thereby resulting in increased crop yield.

The presence of ozone in the plasma treatment chamber not only stimulates germination of the seeds and development of the plants, but has been found to reduce the spread of disease by a factor of 2.7 as compared with untreated control samples.

From the foregoing it will be appreciated that the method of seed treatment described herein represents a substantial improvement over previously known methods in that substantial increases in seed germination, plant development and crop yield can be obtained using a relatively simple plasma treatment apparatus capable of uniform treatment of substantial quantities of seeds placed within the glow discharge volume between the electrodes of the discharge chamber, and which is thus conducive to treatment of agriculturally significant quantities of seeds. Furthermore, the parameters of the plasma discharge and treatment conditions are readily controllable so as to avoid damage to the seeds, particularly through overheating, and for achieving uniform treatment results.

While particular examples of the novel method disclosed herein have been given above for purposes of clarity, it must be understood that many changes, substitutions and modifications to the apparatus described and illustrated herein and to the specific parameters of the plasma treatment can be made without departing from the scope and spirit of the present invention, as will be apparent to those persons possessed of ordinary skill in this art. The scope of the invention protected by this patent is therefore limited only by the following claims:

What is claimed is:

1. A method for the treatment of plant seeds prior to planting comprising the steps of:

providing a gas plasma discharge chamber having spaced apart electrodes;

placing plant seeds to be treated in said chamber between said electrodes;

supplying an inorganic gas or mixture of inorganic gases to said chamber at a pressure of 0.05 Torr to 5 Torr; and applying high frequency electrical power to said electrodes for generating a low temperature plasma discharge between said electrodes.

2. The method of claim 1 wherein said seeds are exposed to said plasma discharge for a treatment time ranging from 5 seconds to 300 seconds.

3. The method of claim 1 wherein said high frequency electrical power has a frequency in the range of 1 MHz to 40 MHz.

4. The method of claim 3 wherein said plasma discharge is characterized by a specific power of 0.003 to 1.5 W/cm3.

5. The method of claim 1 wherein said inorganic gas is selected from the group consisting of oxygen, atmospheric air, and mixtures of nitrogen and oxygen.

6. The method of claim 5 wherein said mixtures of nitrogen and oxygen include a concentration of nitrogen ranging from 0% to 80%.

7. A method for the treatment of plant seeds prior to planting comprising the steps of:

providing a tubular gas plasma discharge chamber having axially spaced apart annular electrodes exterior to and generally coaxial with said chamber;

placing plant seeds to be treated in said chamber between said electrodes;

supplying an inorganic gas or mixture of inorganic gases to said chamber at a pressure of 0.05 Torr to 5 Torr; and applying high frequency electrical power to said electrodes for generating a low temperature plasma discharge between said electrodes for a treatment time ranging from 5 seconds to 300 seconds.

8. The method of claim 7 wherein said high frequency electrical power has a frequency in the range of 1 MHz to 40 MHz and wherein said plasma discharge is characterized by a specific power of 0.003 to 1.5 W/cm3.

9. The method of claim 7 wherein said inorganic gas is selected from the group consisting of oxygen, atmospheric air, and mixtures of nitrogen and oxygen with a concentration of nitrogen ranging from 0% to 80%.

10. A method for the treatment of plant seeds prior to planting comprising the steps of:

providing a gas plasma discharge chamber having spaced apart electrodes;

placing plant seeds to be treated in said chamber between said electrodes;

supplying an inorganic gas selected from the group consisting oxygen, atmospheric air, and mixtures of nitrogen and oxygen with a concentration of nitrogen ranging from 0% to 80% to said chamber at a pressure of 0.05 Torr to 5 Torr; and applying high frequency electrical power in the range of 1 MHz to 40 MHz to said electrodes for generating a low temperature plasma discharge at a specific power of 0.003 to 1.5 W/cm3 between said electrodes for a treatment time ranging from 5 seconds to 300 seconds.

* * * * *